United States Patent [19]

Weaver

[11] 4,033,457

[45] July 5, 1977

[54] REEL-WINDABLE CONTAINER CARRIER STOCK

[75] Inventor: William Norfred Weaver, Glen Ellyn, Ill.

[73] Assignee: Illinois Tool Works Inc., Chicago, Ill.

[22] Filed: June 14, 1976

[21] Appl. No.: 695,665

Related U.S. Application Data

[63] Continuation of Ser. No. 541,742, Jan. 17, 1975, abandoned.

[52] U.S. Cl. ..... 206/390; 206/150; 206/820; 294/87.2

[51] Int. Cl.[2] ..... B65D 85/66

[58] Field of Search ..... 229/52 B; 294/87.2, 294/87.26; 206/427, 820, 390, 150, 151, 147, 145, 156

[56] References Cited

UNITED STATES PATENTS

| | | | |
|---|---|---|---|
| 3,032,944 | 5/1962 | Hull et al. | 53/48 |
| 3,044,230 | 7/1962 | Fisher | 294/87.2 |
| 3,232,422 | 2/1966 | Whyte | 206/150 |
| 3,258,288 | 6/1966 | Courter | 294/87.2 |
| 3,383,828 | 5/1968 | Cunningham | 53/48 |
| 3,504,790 | 4/1970 | Owen | 294/87.2 |
| 3,711,145 | 1/1973 | Rapata | 294/87.2 |
| 3,733,100 | 5/1973 | Tanzer | 294/87.2 |
| 3,830,361 | 8/1974 | Klygis | 206/150 |
| 3,874,502 | 4/1975 | Weaver | 206/150 |

*Primary Examiner*—George E. Lowrance
*Assistant Examiner*—Bruce H. Bernstein
*Attorney, Agent, or Firm*—Edward L. Benno; Robert W. Beart

[57] ABSTRACT

A reel-windable container carrier stock which is formed from a thin resilient plastics sheet material and wound upon a reel with substantial numbers of carriers in the strip for machine application of the strip to containers such as cans to form multipacks. The longitudinal center portion of each carrier in the strip is formed with certain curvilinear tabs to increase the mass of the plastics sheet material on each side of the longitudinal center line of the strip to provide that as the carrier is wound upon the reel the carrier will have a reel configuration with a central annular circumferential hump. That reel configuration provides for excellent high speed winding characteristics of the carrier stock.

3 Claims, 3 Drawing Figures

Fig. 1
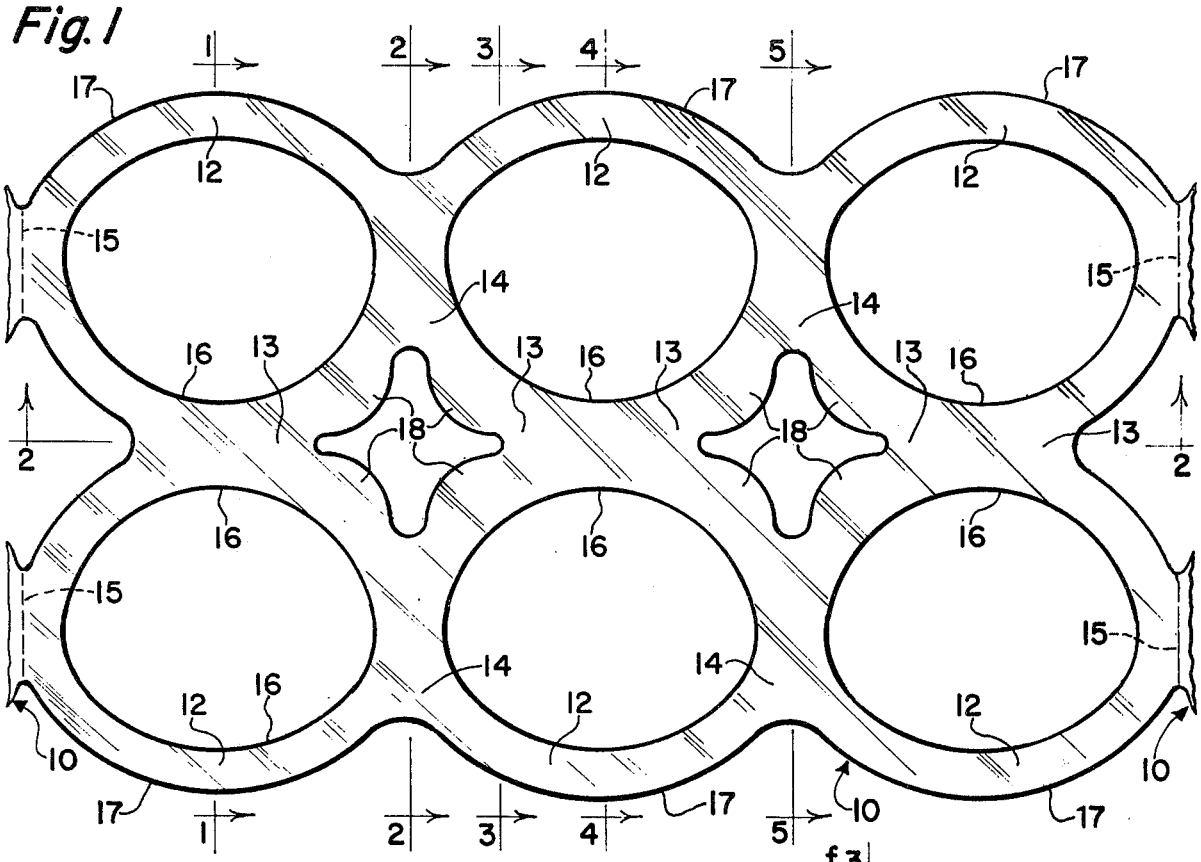
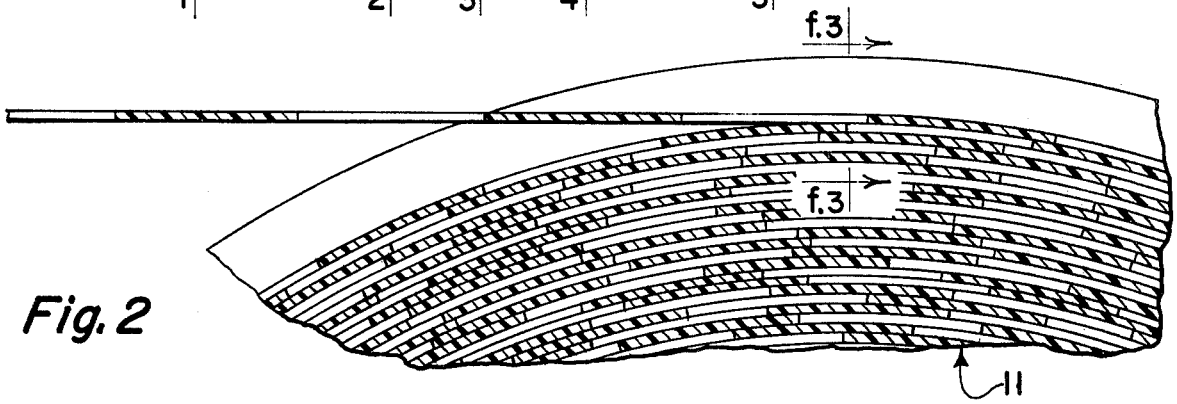
Fig. 2
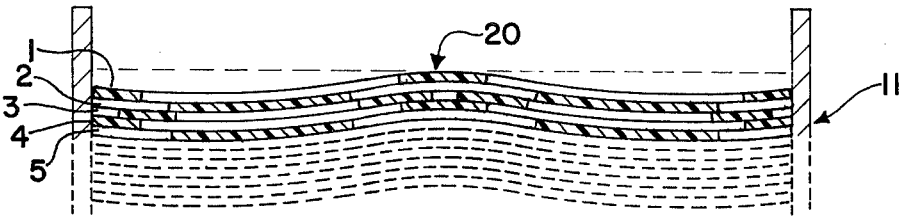
Fig. 3

REEL-WINDABLE CONTAINER CARRIER STOCK

This is a continuation of application Ser. No. 541,742, filed Jan. 17, 1975, now abandoned.

BACKGROUND OF THE INVENTION

In the art of strip formed carrier stock of thin resilient plastics material which upon being manufactured are wound upon a reel for shipment in that form to a brewery or canner for high speed machine application to containers such as cans, many different forms of carrier configurations have been developed. As the art has advanced, such carrier constructions have been made with increasingly less surface area of the plastics material in each carrier. As a result of those developments many of the newer carriers are difficult to reel wind to the commerical detriment of such carriers. Most of the thin plastics sheet carriers presently known in the art are improvements of the invention shown and described in the U.S. Pat. No. 2,874,835 to O. J. Poupitch. The sheet formed carriers presently used in the art are generally applied to containers by machines such as shown in U.S. Pat. Nos. 3,032,943, 3,032,944 and 3,383,828. Reference is made to those patents wherein reels are shown, and carrier stock is shown as it is taken from the reels and applied to containers.

SUMMARY OF THE INVENTION

The present invention is concerned with a container carrier stock which is formed from a thin resilient plastics sheet material and is wound upon a reel in a strip form of a large number of carriers. Reductions to practice of the invention have established that the carrier of the invention winds upon a reel in the manufacture of the carrier with a reel configuration that produces an unexpectedly firm and well aligned reel of carrier stock. The excellent results achieved in winding with the subject carrier are believed due to certain curvilinear tabs formed within the carrier which add mass or material to the think plastics sheet material on each side of the longitudinal center line of the carrier strip or stock. Those tabs on that carrier appear to produce a slight central hump in the circumferential center portion of the carrier strip as it is wound on the reel, and somehow that hump in cooperation with the container encircling bands of the carrier provides for the firm and well aligned carrier stock on the reel.

The objects and features of the invention will be readily apparent upon a perusal of the hereinafter following specification and drawings.

BRIEF DESCRIPTION OF THE DRAWINGS

FIG. 1 is a top plan view of a preferred embodiment of one carrier in the carrier stock of the present invention;

FIG. 2 is a cross-sectional view of a peripheral portion of a reel showing the winding of the carrier stock of FIG. 1 and taken substantially along the line 2 — 2 of FIG. 1; and FIG. 3 is a transverse cross-sectional view of the reel of FIG. 2 further showing the manner of overlap of wound carriers of FIG. 1 in the reel with the top five layers taken substantially along the transverse lines of FIG. 1 and numbered 1 — 1 through 5 —5.

DETAILED DESCRIPTION OF THE PREFERRED EMBODIMENT

In the preferred embodiment shown in FIG. 1, each carrier in the strip of carrier stock has six integral interconnected container encircling bands so that each carrier upon application to containers and upon severance of the stock between carriers will form the well-known six-pack of beverages, such as, beer or soft drinks. It is intended that upon application to containers, the carrier of the subject invention may also be slit along its longitudinal center line to form two three-packs. The strip of carrier stock generally includes at least 4,000 individual carriers wound upon a reel which in that form is shipped to a brewer or bottler for machine application by applicating machines such as shown in the above-noted patents.

Generally, the sheet material used in the manufacture of the carrier stock is a low density polyethylene material of a nominal thickness of eighteen thousandths of an inch or forty-six thousandths of a centimeter. In the preferred embodiment, one carrier 10 is shown with small edge portions of adjacent carriers 10 in the strip shown at each end of the complete carrier 10. In the carrier stock of the invention identical carriers 10 are formed in a repeating end-to-end pattern of at least 4,000 carriers for winding upon the reel 11, such as partially shown in FIGS. 2 and 3 for a convenient commercial quantity of carrier stock.

Each carrier 10 comprises six container encircling bands 12. The bands 12 are arranged in transverse pairs with three adjacent pairs constituting one carrier 10. The bands 12 of each pair of bands are integrally interconnected by a web 13 extending between the outer marginal edges of the bands 12. Adjacent pairs of bands 12 in the carrier 10 are integrally interconnected by webs 14 extending between the outer marginal edges of the adjacent pairs of bands 12. Substantially no webbing is provided between adjacent carriers in the carrier stock. The outer marginal edges of adjacent carriers 10 in the carrier stock are connected slightly more than tangentially along the lines of interconnection 15, shown in FIG. 1.

The inner periphery of each band 12 is defined by a continuous uninterrupted inner marginal edge 16 in the general shape of a modified oval. The outer marginal edges 17 of the bands 12 are substantially parallel to the inner marginal edges 16. The extensions of the outer marginal edges 17 through the webs 13 and 14 may also be described as substantially parallel to the inner marginal edge 16 of the bands 12.

The portions of the extended outer marginal edges of the bands 12 between a web 13 and a web 14 are provided with curvilinear radially outwardly extending tabs 18. From the foregoing it is apparent that the tabs 18 add material in excess of the uniform width bands on each side of the longitudinal center line through the carrier 10. In winding the carrier stock upon a reel, the tabs 18 cause the center of the reel wound carrier stock to be configured with a slight hump 20, shown in FIG. 3. The slight hump 20 ensures that the carrier as manufactured will be firmly and accurately aligned layer-upon-layer about the reel.

Some further understanding of the problem and solution offered by the present invention may be gained by a consideration of FIGS. 2 and 3. Because of the ever increasing diameter of the stock as it is wound upon the reel, there are varying longitudinally aligned relationships between carriers of adjacent layers on the reel. Thus, for example, as shown in FIG. 3, the section taken shows cross sections of carriers 10 at different longitudinal positions such as along line 1 — 1 for the top layer, line 2 — 2 in the second layer from the top, line 3 — 3 in the third layer from the top, line 4 — 4 in the fourth layer from the top, and line 5 — 5 in the fifth layer from the top. In such relative carrier alignments on the reel, the web areas 14 in one layer will often lie in the band aperture of an adjoining layer. Further, the outer band portions of the bands 12 will oftentimes lay over and partially within the area outwardly of the web Area 14 of the next layer. That inter-nesting of layers of carriers on a reel oftentimes causes poor winding of the carrier stock upon the reel. However, in reductions to practice of the invention, it appears that the tabs 18 provide enough additional material or mass in each layer and in cooperation with adjacent layers to produce the sight hump 20 of FIG. 3. As noted, the maintenance of the slight hump 20 in winding produces a unexpectedly firm and well aligned reel of carrier stock of carrier 10.

Having described the invention, it is to be understood that changes can be made in the described embodiment by one skilled in the art within the spirit and scope of the invention as defined in the claims.

I claim:

1. A roll of container carrier stock wound in superposed layers and having a central annular circumferential hump, said stock comprising a strip of multiple container carriers connected in series in an end-to-end relationship, each of the multiple container carriers in said strip comprising a plurality of pairs of container encircling bands and integral webs interconnecting the bands of each pair of bands and the adjacent pairs of bands in said carrier, integral connections between the ends of adjacent carriers in said strip, each of said bands having a inner peripheral edge and an outer marginal edge extending between said webs and said integral connections, said pairs of bands in each carrier arranged transversely of said strip, said bands and webs and said integral connections between adjacent carriers in said strip being formed from a thin resilient plastics sheet material, said inner peripheral edge and said outer marginal edge of each of said bands in each carrier including said outer marginal edge extended through said webs and through said integral connections being substantially parallel circumferentially thereof, and each of said carriers including radially outward curvilinear tabs integrally extending from the outer marginal edges of the portions of each two adjacent bands in each carrier which are circumferentially between the webs interconnecting the bands of each pair of bands and the webs interconnecting said adjacent bands to substantially increase the mass of said plastics sheet material on each side of the longitudinal center line of said strip and to form said central annular circumferential hump.

2. A roll of container carrier stock as described in claim 1, wherein the radially outward curvilinear tabs from the outer marginal edges of each pair of bands comprise four tabs arranged in quadrature.

3. A roll of container carrier stock as described in claim 1, wherein each of said radially outward curvilinear tabs has a radius of curvature smaller than the radius of curvature of the inner peripheral edge of the circumferential portion of the band from which said tab extends.

* * * * *